United States Patent [19]

Bromley et al.

[11] Patent Number: 4,482,309

[45] Date of Patent: Nov. 13, 1984

[54] DESENSITIZED SPINNERET

[75] Inventors: James E. Bromley, Pensacola, Fla.; John R. Dees, Charlotte, N.C.

[73] Assignee: Celanese Corporation, New York, N.Y.

[21] Appl. No.: 501,319

[22] Filed: Jun. 6, 1983

Related U.S. Application Data

[62] Division of Ser. No. 349,794, Feb. 18, 1982, Pat. No. 4,411,852.

[51] Int. Cl.[3] ..... A21C 3/00

[52] U.S. Cl. ..... 425/131.5; 425/463; 425/DIG. 217

[58] Field of Search ..... 264/168, 177 F, 171; 425/131.5, 463, DIG. 217

[56] References Cited

U.S. PATENT DOCUMENTS 3,387,327 6/1968 Privott et al. ..... 264/171

3,497,585 2/1970 Chapman et al. ..... 264/171

*Primary Examiner*—Jay H. Woo

*Assistant Examiner*—James C. Housel

*Attorney, Agent, or Firm*—Stephen M. Bodenheimer, Jr.

[57] ABSTRACT

Molten polymer streams are separately metered to the individual capillaries of a combined orifice, rendering the yarn produced less dependent on the capillary dimensions.

4 Claims, 2 Drawing Figures

FIG 3

DESENSITIZED SPINNERET

This is a division of application Ser. No. 349,794 filed Feb. 18, 1982, now U.S. Pat. No. 4,411,852.

The invention relates to the art of melt spinning through combined orifices.

A combined orifice is one wherein two or more capillaries are located and arranged on a spinneret face such that molten streams extruded through the capillaries unite below the spinneret face and there combine to form a single molten stream which is then quenched to form a filament. Spinning through combined orifices is disclosed in British Specification No. 2,003,423 published Mar. 14, 1979, and in Japanese patent publication No. 42,415 (1979).

Yarns spun from nominally identical spinnerets, as disclosed in these references, frequently have substantially different properties, due to very minor machining errors. This sensitivity of the prior spinneret design is disadvantageous in a commercial context wherein it is desirable that yarns made from many spinnerets be substantially identical in properties.

These and other difficulties of the prior design are overcome by the present invention.

DESCRIPTION OF THE INVENTION

According to a first major aspect of the invention, there is provided a melt spinning apparatus, comprising a spinneret having a plurality of combined orifices, each of the combined orifice comprising first and second capillaries; and means for substantially independently metering polymer volumetric flow through each capillary; whereby the polymer volumetric flows are substantially insensitive to variations in the dimensions of the capillaries. According to another aspect of the invention, the first and the second capillaries have different cross-sectional areas at the face of the spinneret. According to another aspect of the invention the means for metering polymer flow comprises a separate polymer metering passageway associated with each capillary, each separate passageway being interposed between a pressurized common plenun polymer source and the capillary with which each passageway is associated; each passageway having dimensions selected to provide a pressure drop thereacross at least twice as large as the pressure drop across the capillary with which each passageway is associated.

According to a second major aspect of the invention, there is provided a melt spinning apparatus, comprising a plenum continuously supplied with molten polymer; a spinneret having at least one combined orifice comprising first and second capillaries; a first metering passageway connecting the first capillary to the plenum, the first metering passageway providing a pressure drop thereacross at least twice as large as the pressure drop across the first capillary; and a second metering passageway connecting the second capillary to the plenum, the second metering passageway providing a pressure drop thereacross at least twice as large as the pressure drop across the second capillary. According to another aspect of the invention, the first and the second capillaries have different cross-sectional areas at the face of the spinneret.

According to a third major aspect of the invention, there is provided a process for melt-spinning through a spinneret having at least one combined orifice comprising first and second capillaries, the process comprising metering a first polymer stream through the first capillary; and metering a second polymer stream through the second capillary, whereby the polymer volumetric flows through the first and second capillaries are substantially insensitive to the dimensions of the capillaries. According to another aspect of the invention, the first and the second capillaries have different cross-sectional areas at the face of the spinneret.

According to a fourth major aspect of the invention, there is provided a melt-spinning process comprising continuously supplying molten polymer to a plenum; conveying a first stream of the polymer from the plenum through a first metering passageway to a first capillary of a combined orifice in a spinneret, the first metering passageway providing a pressure drop thereacross at least twice as large as the pressure drop across the first capillary; and conveying a second stream of the polymer from the plenum through a second metering passageway to a second capillary of the combined orifice, the second metering passageway providing a pressure drop thereacross at least twice as large as the pressure drop across the second capillary. According to another aspect of the invention, the first and the second capillaries have different cross-sectional areas at the face of the spinneret.

Other aspects will in part appear hereinafter and will in part be apparent from the following detailed description taken in connection with the accompanying drawing, wherein.

Figure 1:
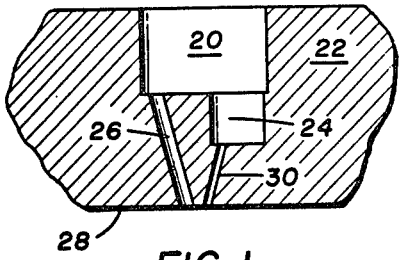
FIG. 1. (PRIOR ART)
FIG. 1 is a vertical sectional view of the of the prior art design.

In the prior art design, large counterbore 20 is formed in the upper surface 21 of spinneret plate 22. Small counterbore 24 is formed in the bottom of and at one side of counterbore 20. Large capillary 26 extends from the bottom of counterbore 20 at the side opposite counterbore 24, and connects the bottom of counterbore 20 with the lower face or surface 28 of plate 22. Small capillary 30 connects the bottom of counterbore 24 with surface 28. Capillaries 26 and 30 are separated by a small land on the face of the spinneret, and, together with counterbore 20 and 24 constitute a combined orifice for spinning a single filament.

As disclosed in the references noted above, the separate sub-streams flowing from capillaries 26 and 30 travel at different speeds as they emerge from the capillaries, resulting in oscillations as they unite below the spinneret surface.

If (for example) as a result of a machining error capillary 26 is shorter than intended, not only will its polymer sub-stream flow at higher velocity, but the mass flow in that sub-stream will also proportionately increase. Since the momentum of the sub-stream is the product of velocity and mass, a machining error sufficient to give an increase in velocity of 5% will result in a 10.25% error in inertia of the sub-stream, substantially affecting the oscillations and accordingly the physical properties of the resulting filament.

Figure 2:
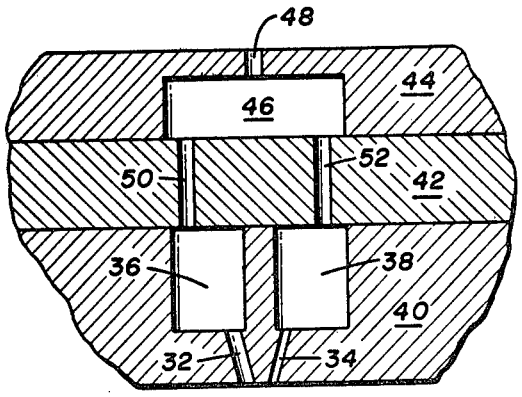
FIG. 2 is a vertical sectional view of the present invention.

The invention avoids this multiplying effect by substantially isolating or separately controlling the metering (mass or volumetric flow) and velocity functions. As shown in FIG. 2, the exemplary combined orifice comprises large diameter capillary 32 and small diameter capillary 34 located at the bottoms of separate respective counterbore 36 and 38 in spinneret plate 40. Metering plate 42 is mounted upstream of and abutting spinneret plate 40, while distribution plate 44 is mounted upstream of and abutting metering plate 42. Plenum chamber 46 is formed in the lower face of plate 44, and is supplied with molten polymer through passageway 48. Metering passageway 50 connects plenum 46 via counterbore 36 to capillary 32, while metering passageway 52 connects plenum 46 via counterbore 38 to capillary 34.

Metering passageways 50 and 52 each have dimensions selected to provide a pressure drop thereacross at least twice as large as the pressure drop across is associated capillary. As exemplary dimensions, metering passageways may have diameters of 0.016 inch (0.406 mm.) and lengths of 0.146 inch (3.71 mm.), while capillary 32 has a diameter of 0.016 inch (0.406 mm.) and a length of 0.020 inch (0.51 mm.) and capillary 34 has a diameter of 0.009 inch (0.229 mm.) and a length of 0.020 inch (0.51 mm.). The axes of the capillaries may form an included angle, for example, eight degrees, and an exemplary width for the land separating the capillaries on the lower face of spinneret plate 40 is 0.004 inch (0.1016 mm.).

Since most of the pressure drop occurs across the metering passageways, polymer volumetric flows through the capillaries are substantially less sensitive to minor dimensional errors than they would be without the metering passageways, and yarns spun according to the present invention are substantially less variable in their bulk and crimp properties than yarns spun as taught in the references noted above.

What is claimed is:

1. Melt spinning apparatus, comprising:

(a) a spinneret having a plurality of combined orifices, each said combined orifice comprising first and second capillaries; and (b) means for substantially independently metering polymer volumetric flow through each said capillary;

(i) said means for metering polymer flow comprising a separate polymer metering passageway associated with each said capillary, (ii) each said separate passageway being interposed between a pressurized comnon plenum polymer source and the said capillary with which each said passageway is associated, (iii) each said passageway having dimensions selected to provide a pressure drop there across at least twice as large as the pressure drop across the said capillary with which each said passageway is associated, whereby said polymer volumetric flows are substantially insensitive to variations in the dimensions of said capillaries.

2. The apparatus defined in claim 1, wherein said first and second capillaries have different cross-sectional areas at the face of said spinneret.

3. Melt spinning apparatus, comprising:

(a) a plenum continuously supplied with molten polymer;

(b) a spinneret having at least one combined orifice comprising first and second capillaries;

(c) a first metering passageway connecting said first capillary to said plenum, said first metering passageway providing a pressure drop thereacross at least twice as large as the pressure drop across said first capillary; and (d) a second metering passageway connecting said second capillary to said plenum, said second metering passageway providing a pressure drop thereacross at least twice as large as the pressure drop across said second capillary.

4. The apparatus defined in claim 3, wherein said first and said second capillaries have different cross-sectional areas at the face of said spinneret.

* * * * *

UNITED STATES PATENT AND TRADEMARK OFFICE

CERTIFICATE OF CORRECTION

PATENT NO. : 4,482,309

DATED : November 13, 1984

INVENTOR(S) : James E. Bromley

It is certified that error appears in the above-identified patent and that said Letters Patent is hereby corrected as shown below:

The title page should appear as shown on the attached sheet.

Signed and Sealed this

*Thirtieth* Day of *April 1985*

[SEAL]

*Attest:*

DONALD J. QUIGG

*Attesting Officer* *Acting Commissioner of Patents and Trademarks*

United States Patent [19]

Bromley et al.

[11] Patent Number: 4,482,309

[45] Date of Patent: Nov. 13, 1984

[54] DESENSITIZED SPINNERET

[75] Inventors: James E. Bromley, Pensacola, Fla.; John R. Dees, Charlotte, N.C.

[73] Assignee: Celanese Corporation, New York, N.Y.

[21] Appl. No.: 501,319

[22] Filed: Jun. 6, 1983

Related U.S. Application Data

[62] Division of Ser. No. 349,794, Feb. 18, 1982, Pat. No. 4,411,852.

[51] Int. Cl.[3] ..... A21C 3/00

[52] U.S. Cl. ..... 425/131.5; 425/463; 425/DIG. 217

[58] Field of Search ..... 264/168, 177 F, 171; 425/131.5, 463, DIG. 217

[56] References Cited

U.S. PATENT DOCUMENTS 3,387,327 6/1968 Privott et al. ..... 264/171

3,497,585 2/1970 Chapman et al. ..... 264/171

*Primary Examiner*—Jay H. Woo

*Assistant Examiner*—James C. Housel

*Attorney, Agent, or Firm*—Stephen M. Bodenheimer, Jr.

[57] ABSTRACT

Molten polymer streams are separately metered to the individual capillaries of a combined orifice, rendering the yarn produced less dependent on the capillary dimensions.

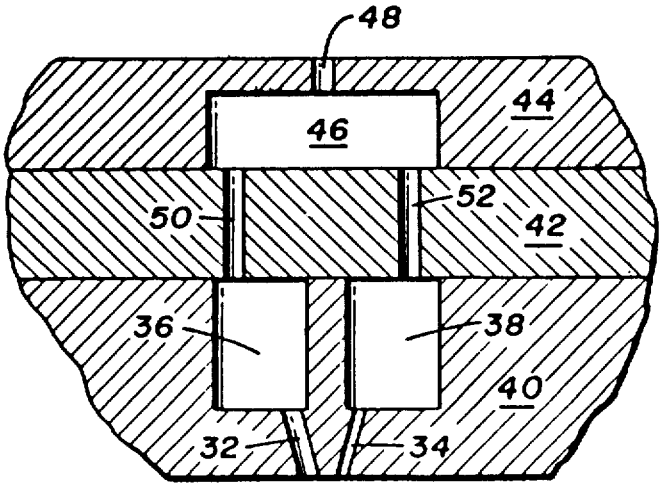

4 Claims, 2 Drawing Figures